US005697606A

United States Patent [19]

Maass

[11] Patent Number: 5,697,606

[45] Date of Patent: Dec. 16, 1997

[54] DEVICE FOR ADAPTING NEGATIVE PRESSURE IN A SUCTION BELT FEED TABLE OF A SHEET FEEDER TO VARYING OPERATING CONDITIONS

[75] Inventor: Burkhard Maass, Heidelberg, Germany

[73] Assignee: Heidelberger Druckmaschinen AG, Heidelberg, Germany

[21] Appl. No.: 437,289

[22] Filed: May 8, 1995

[30] Foreign Application Priority Data

May 7, 1994 [DE] Germany ..... 44 162 86.3

[51] Int. Cl.[6] ..... B65H 29/32

[52] U.S. Cl. ..... 271/197; 271/196; 271/276; 198/689.1

[58] Field of Search ..... 271/276, 196, 271/197; 198/689.1

[56] References Cited

U.S. PATENT DOCUMENTS

| | | | |
|---|---|---|---|
| 3,715,115 | 2/1973 | Grobman | 271/44 |
| 5,133,593 | 7/1992 | Eitel et al. | 271/197 |
| 5,241,907 | 9/1993 | Dorsam et al. | 271/276 |
| 5,288,067 | 2/1994 | Stock | 271/276 |

FOREIGN PATENT DOCUMENTS

| | | | |
|---|---|---|---|
| 0 454 011 | 10/1991 | European Pat. Off. . | |
| 0 554 774 | 8/1993 | European Pat. Off. . | |
| 2 352 742 | 12/1977 | France . | |
| 1 976 230 | 1/1968 | Germany . | |
| 1 938 070 | 8/1972 | Germany . | |
| 23 26 524 | 12/1975 | Germany . | |
| 22 01 254 | 7/1976 | Germany . | |
| 27 07 170 | 7/1982 | Germany . | |
| 30 01 652 | 9/1984 | Germany . | |
| 40 13 302 | 10/1991 | Germany . | |
| 42 03 511 | 8/1993 | Germany . | |
| 42 03 511 A1 | 8/1993 | Germany . | |
| 4-91953 | 8/1992 | Japan . | |
| 48409 | 9/1984 | U.S.S.R. | 271/197 |

*Primary Examiner*—William E. Terrell
*Assistant Examiner*—Khoi H. Tran
*Attorney, Agent, or Firm*—Herbert L. Lerner; Laurence A. Greenberg

[57] ABSTRACT

Device for adapting negative pressure in a suction belt feed or supply table of a sheet feeder to operating conditions which vary during sheet conveyance, having at least one endless, revolvingly driven conveyor belt provided with suction openings, and a side alignment device for laterally aligning a respectively foremost sheet of a shingled or overlapping sheet stream, and at least one suction box disposed below a conveying plane, the suction box, in a sheet feeding direction, being subdivided into a plurality of chambers subjectible to negative pressure independently of one another, includes a conveyor belt, a plurality of suction chambers disposed in the conveying plane below the conveyor belt, a common suction union and a swivelable shutoff element for selectively connecting the suction chambers to the suction union.

11 Claims, 6 Drawing Sheets

DEVICE FOR ADAPTING NEGATIVE PRESSURE IN A SUCTION BELT FEED TABLE OF A SHEET FEEDER TO VARYING OPERATING CONDITIONS

BACKGROUND OF THE INVENTION

Field of the Invention

The invention relates to a device for adapting negative pressure in a suction belt feed or supply table of a sheet feeder to operating conditions which vary during sheet feeding, having at least one endless, revolvingly driven conveyor belt provided with suction openings, a side alignment device for laterally aligning a respectively foremost sheet of a shingled or overlapping sheet stream, and a suction box disposed below a conveying plane, the suction box, in the sheet feeding direction, being subdivided into a plurality of chambers subjectible to negative pressure independently of one another.

From the prior art, the published Japanese Utility Model Document Hei 4-91953, discloses a device for reversing suction action. An articulatedly mounted adjusting cylinder, via a lever, turns a pivot shaft to which a flap provided with two sealing faces is secured. With the flap, communication with either standard atmospheric pressure or with a negative pressure source can be realized. This conventional device suffers disadvantageously from the fact that, in order to accomplish the reversal, a complete 90° swiveling movement of the flap must be executed. As a result, because of the inertia of the mass to be swiveled, a specific amount of time for the swiveling is required. Hence, during the swiveling time period, no clearly or unequivocally defined switching state is offered. At high sheet conveying speeds, an abrupt atmospheric aeration of a suction chamber is therefore impossible.

The feeding of a shingled sheet stream on the feed table of a feeder to a sheet-fed rotary printing press can be divided into three phases. The first phase, which commences with the startup of the press, may be characterized by the first sheet, which has been pushed onto the suction belt by a singling or sheet separating device, being sucked against the perforated conveyor belt with as little slippage as possible. In this phase of press operation, however, the suction force is basically reduced by the fact that only a given region of the conveyor belt is covered by the first sheet, and thus a very large amount of unused air is aspirated, which limits the suction action. The first phase is especially critical if work is done with a short overlap or stagger distance between the sheets and either with or without drive rollers on the belt or tape drive roller at the upper end of the feed table.

In the second phase, namely the conveyance of the shingled or overlapping sheet stream, which corresponds somewhat to the stationary or steady operating state of the system, constant operating conditions prevail, so that this second phase can be considered unproblematic.

The third phase of conveying a shingled or overlapping sheet stream pertains to the conveyance of the final sheet of the shingled or overlapping sheet stream. This last sheet is sucked over its entire length against the conveyor belt and is thus fixed with considerably greater strength to the conveyor belt than the partly overlapping sheets of the shingled sheet stream. In the stream, the overlapping of the individual sheets is such that the sheets are in contact with the conveyor belt over only a fraction of their surface area, and therefore are subjected to a lesser suction action. If the final sheet, while it is being transported towards the front lays, is exposed to the negative pressure prevailing in the delivery table, on the one hand, the leading edge of the final sheet can be pressed against the front lays and, on the other hand, the lateral alignment can be hindered considerably.

One possible solution to this problem has become known heretofore from the published German Patent Document DE 42 03 511 A1. Disclosed therein is a device for conveying a shingled or overlapping sheet stream to a sheet-processing machine equipped with a feeder table which contains a sensor for detecting the final sheet. After a period of time following the detection of the final sheet, a period of time which is equivalent to the time that had been required for feeding the number of sheets preceding the final sheet, the negative pressure source of a negative pressure box upstream from the front lays is shut off, and the negative pressure box is subjected to overpressure from an overpressure source, instead of the negative pressure. To overcome the suction action to which the final sheet is exposed, this negative pressure box upstream of the front lays is acted upon by an overpressure surge, the metering of which is difficult at best. If the overpressure surge is too strong, the final sheet can be actually blown off the conveyor belt, resulting in precisely the opposite of what was intended. Then, a correct alignment appears no longer to be possible. Moreover, in this device of the prior art, an additional connection for blown air is absolutely indispensible.

Starting from the technical problem discussed above and the inadequacies of the foregoing devices of the prior art, it is an object of the invention to provide a device for adapting negative pressure in a suction belt feed table of a sheet feeder to varying operating conditions, such as the operating phase existing at a particular time, which is offers a marked improvement over the heretofore known devices of the general type.

SUMMARY OF THE INVENTION

With the foregoing and other objects in view, there is provided, in accordance with the invention, a device for adapting negative pressure in a suction belt feed or supply table of a sheet feeder to operating conditions which vary during sheet conveyance, having at least one endless, revolvingly driven conveyor belt provided with suction openings, and a side alignment device for laterally aligning a respectively foremost sheet of a shingled or overlapping sheet stream, and at least one suction box disposed below a conveying plane, the suction box, in a sheet feeding direction, being subdivided into a plurality of chambers subjectible to negative pressure independently of one another, comprising a conveyor belt, a plurality of suction chambers disposed in the conveying plane below the conveyor belt, a common suction union and a swivelable shutoff element for selectively connecting the suction chambers to the suction union.

In accordance with another feature of the invention, the suction union is bounded by a defining plane, and the swivelable shutoff element is disposed in the defining plane.

In accordance with a further feature of the invention, the device includes a swivel shaft to which the swivelable shutoff element is secured eccentrically.

In accordance with an added feature of the invention, the swivelable shutoff element is formed with a longer and a shorter segment, respectively, secured to the swivel shaft, the shorter segment being swivelable with the swivel shaft for closing and opening an air supply opening within a boundary.

In accordance with an additional feature of the invention, the longer segment is also secured to the swivel shaft and is swivelable therewith for interrupting communication of at least one of the suction chambers with the suction union.

In accordance with yet another feature of the invention, the device includes crossbars to which the suction chambers are secured below the conveying plane.

In accordance with yet a further feature of the invention, the crossbars, respectively, are perforated with apertures, the apertures being located outside a swiveling range of the swivelable shutoff element.

In accordance with yet an added feature of the invention, each of the crossbars carries a respective suction box.

In accordance with yet an additional feature of the invention, the suction chambers are in permanent communication with the suction union via the apertures.

In accordance with another feature of the invention, the swivelable shutoff element is actuatable by remote control.

In accordance with a concomitant feature of the invention, the crossbars define boundaries of the suction union.

With the foregoing construction of the device according to the invention, it is possible to dispense with a separate switchover to overpressure at the overpressure box in the feed table, because the location of the vacuum which is operative in the conveying plane can be varied by relatively simple means. Because the swivelable shutoff element is disposed below the suction chambers, the suction conduit or channel to the middle suction chamber, for example, can be made quite short, due to which, it is possible to achieve short response times with respect to compensating for the negative pressure. An abrupt reduction of the negative pressure operative in the conveying plane is thus possible, a fact which means fractions of a second at the printing speeds currently demanded.

The concept upon which the invention of the instant application is based undergoes further refinements in that the swivelable shutoff element is disposed in a plane of a defining boundary of the suction union. Thus, in a passive position, it offers no flow resistance in the suction union and enables the source of suction air to be smaller in size.

Moreover, the swivelable shutoff element is secured eccentrically to a pivot shaft. The shorter segment of the swivelable shutoff element resulting from the eccentric support, referred to the swivel shaft, closes or opens an air supply or aeration opening in a boundary wall of the suction union. The longer segment of the shutoff element resulting from the eccentric support, interrupts the communication between the suction chamber and the common suction union. The suction chambers are secured to crossbars below the conveying plane of the sheet stream. The crossbars, in turn, are respectively perforated with apertures which are located outside the swiveling range of the shutoff element. Consequently, the suction chambers, each of the suction conduits or channels of which communicates permanently through the apertures with the common suction union, is permanently acted upon by vacuum and experiences no influence by the swiveling motion of the shutoff element. Moreover, a respective suction box is provided on each of the crossbars, the forward and rearward suction chambers terminating in the respective suction boxes. The actuation of the swivelable shutoff element is realizable either via an adjusting cylinder acted upon by a pressure medium or electromagnetically.

Other features which are considered as characteristic for the invention are set forth in the appended claims.

Although the invention is illustrated and described herein as embodied in a device for adapting negative pressure in a suction belt feed table of a sheet feeder to varying operating conditions, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
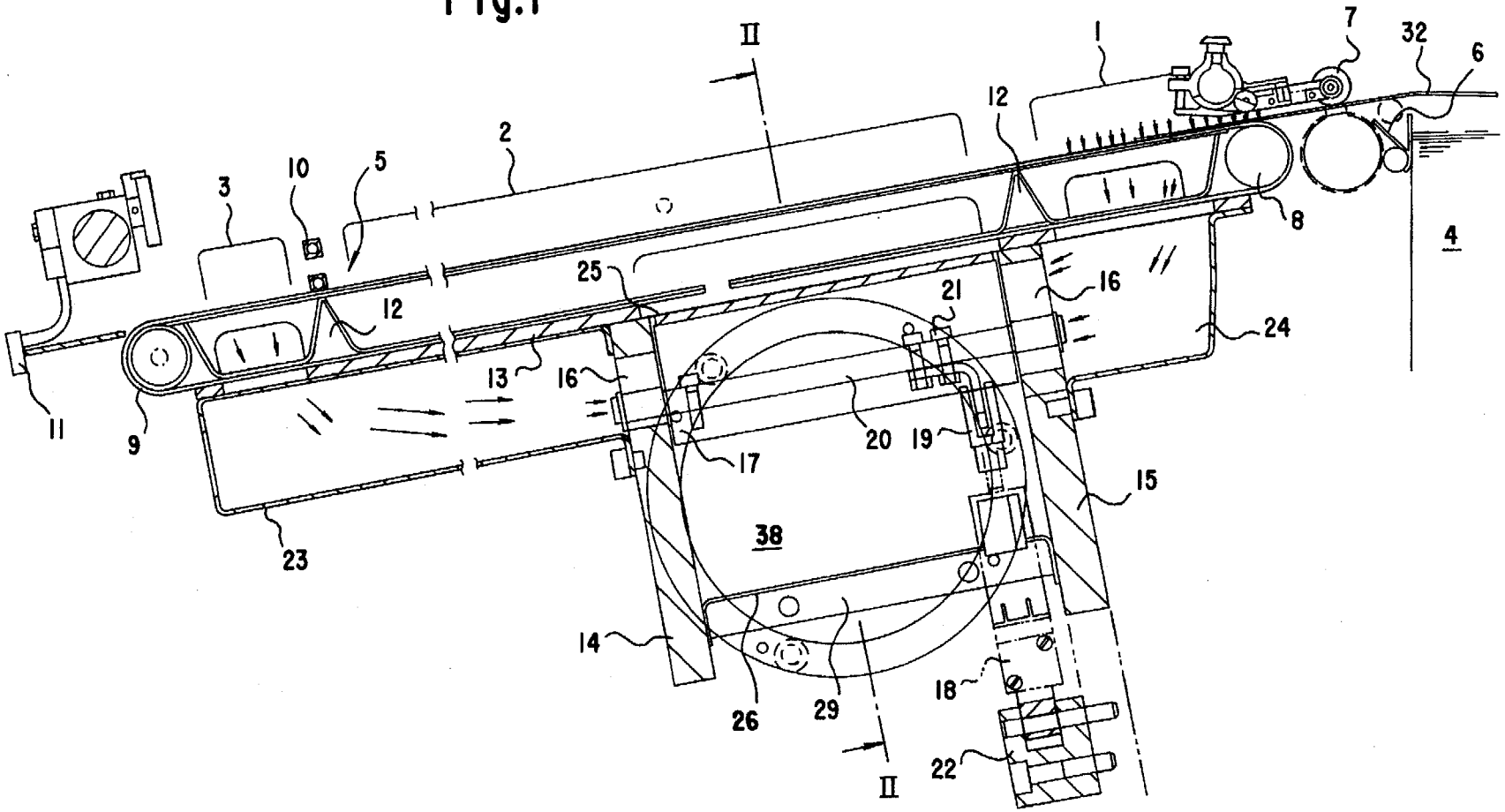
FIG. 1 is a diagrammatic and schematic side elevational view of the device according to the invention for adapting negative pressure to varying operating conditions, the device being shown in a suction belt feed table of a sheet feeder, and in an operating phase thereof wherein negative pressure conditions prevail in the suction chambers, the press being at startup (feeding of the first sheet)

FIG. 1 shows, with respect to a conveying plane 5 for supplying a sheet fed rotary printing press, a plurality, namely three in the figure, of suction chambers 1, 2 and 3, the lengths of which are defined by the associated brackets. The suction chamber 1 is located immediately adjacent to a belt drive roller 8, downstream of a swivelable stop 6 of a feeder sheet pile 4. The thus forward suction chamber 1 extends as far as a first bridge 12 below the conveying plane 5. Adjoining it is the middle suction chamber 2, which extends up to a draw or pull roller 10 of a lateral or side alignment device. The rearward suction chamber 3, which is separated from the middle suction chamber 2 by a sheet-metal part, is located immediately upstream of the draw roller 10. Down-stream of the conveying plane 5 are front lays 11, at which the individual sheets are aligned. Revolving around the suction chambers 1, 2 and 3 is an endless perforated conveyor belt 9, which is driven by the belt drive roller 8, above which synchronizing rollers 7 are disposed. The synchronizing rollers 7 serve, upon startup of the press, to assure the feeding of the first sheet with the least possible slippage while the negative pressure in the suction chamber 1 remains reduced.

The housing in which the suction chambers 1, 2 and 3 are located is mounted on crossbars 14 and 15, which extend transversely to the feeding direction of a sheet stream. The two crossbars 14 and 15 serve as bearing locations for ends of a swivel shaft 20, to which a shutoff element 17 is secured. The shutoff element 17 is attached by means of screw fasteners 21 to the swivel shaft 20. The crossbar 15 carries an abutment or counter-bearing 22, in which an actuating member 18 is articulatedly supported, the actuating member 18 having an end to which a control fork 19 is secured, the extension and retraction of which causes a rotation of the swivel shaft 20. Also located on the crossbar 14 is a forward suction box 23, into which a suction conduit or channel of the suction chamber 3 discharges. Located on the crossbar 15 is a rearward suction box 24, into which a suction conduit or channel of the suction chamber 1 discharges. Both crossbars 14 and 15 are provided with apertures 16, via which the suction boxes 23 and 24 communicate with a common suction pipe union 38. The suction pipe union 38 is bounded by the two crossbars 14 and 15, and is also closed off at its underside by a plate or baffle 29, to which a strip-shaped seal 26 is secured. This seal 26 serves as a stop for an end segment of the shutoff element 17, while a further seal 25, against which the other end of the shutoff element 17 abuts, is provided above the shutoff element 17.

Figure 2:
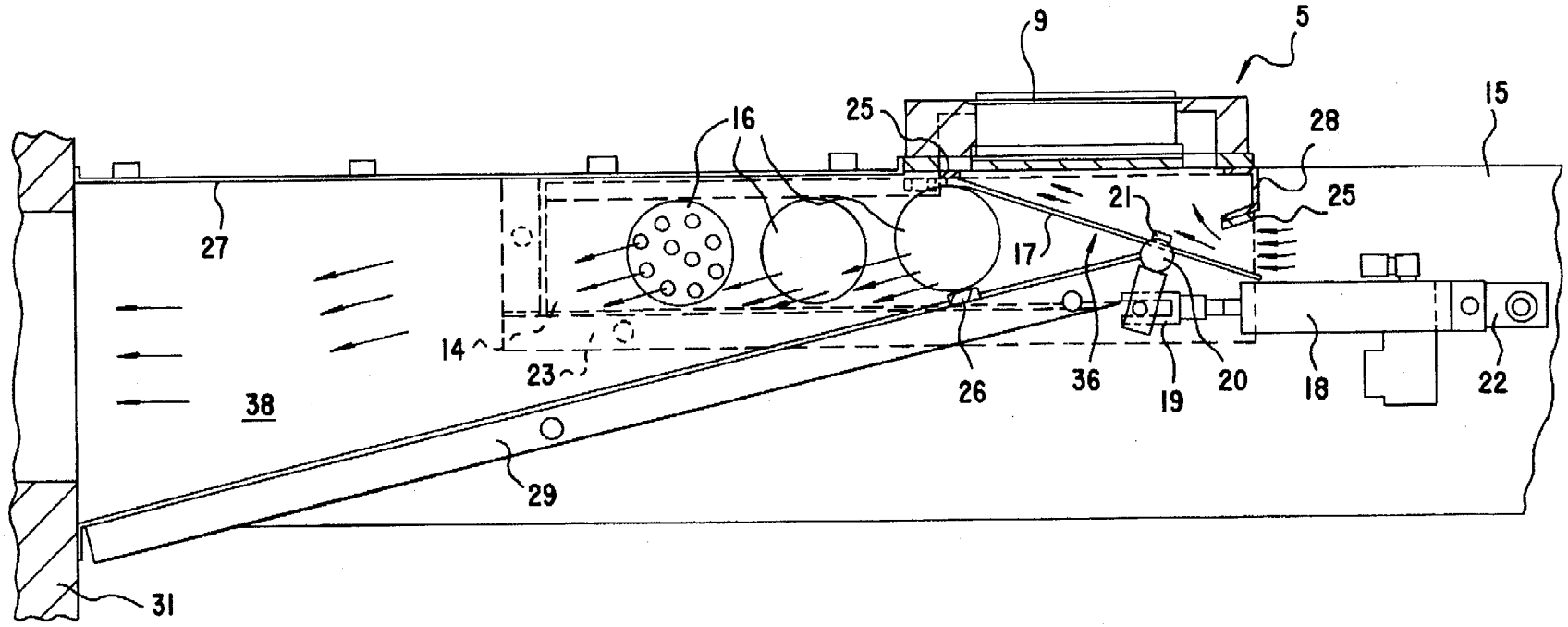
FIG. 2 is a cross-sectional view of FIG. 1 taken along the line II—II in the direction of the arrows, and showing that a supply of atmospheric air has been furnished to the middle suction chamber (feeding of the first sheet)

FIG. 2 is a cross-sectional view of FIG. 1, showing the delivery table in an operating phase thereof wherein the first sheet is being fed.

The housing in which the suction chambers 1, 2 and 3 are formed and about which the endless conveyor belt 9 revolves is located in the middle of the conveying plane 5. The conveying plane 5 is bounded by feeder side parts 31. Table plates or baffles 30 extend between the side parts 31 and the suction chamber housing. The crossbar 15 extends between the feeder side elements 31, and the abutment or counter-bearing 22 of the actuating member 18 is mounted on this crossbar 15. The control fork 19 is connected to the swivel shaft 20 via a lever. The swivel shaft 20, in this exemplary embodiment, divides the swivelable shutoff element 17 at a ratio of approximately 2:1. The eccentric disposition of the shutoff element 17 with respect to the swivel shaft 20 causes a division of the shutoff element 17. The shorter side thereof, as viewed in FIG. 2, opens an atmospheric air supply or aeration opening of the middle suction chamber 2; consequently, the middle suction chamber 2 exerts no suction. Correspondingly, the longer segment of the eccentrically supported shutoff element 17 interrupts the communication between the middle suction chamber 2 and the suction pipe union 38. Because the apertures 16 are formed in those regions of the crossbars 14 and 15 defining the suction pipe union 38 which are located outside the swiveling range of the shutoff element 17, vacuum continues to prevail in the suction chambers 1 and 2, regardless of the position of the shutoff element 17. The shutoff element 17 assumes the position 36 in this operating phase.

The suction pipe union 38 in the illustrated exemplary is formed of a plurality of baffles 27, 28 and 29. It would also be conceivable to construct the suction pipe union 38 in a tubular form, which would result in a different geometry of the shutoff element 17. It would be conceivable to use a rectangular tube, as well.

Figure 3:
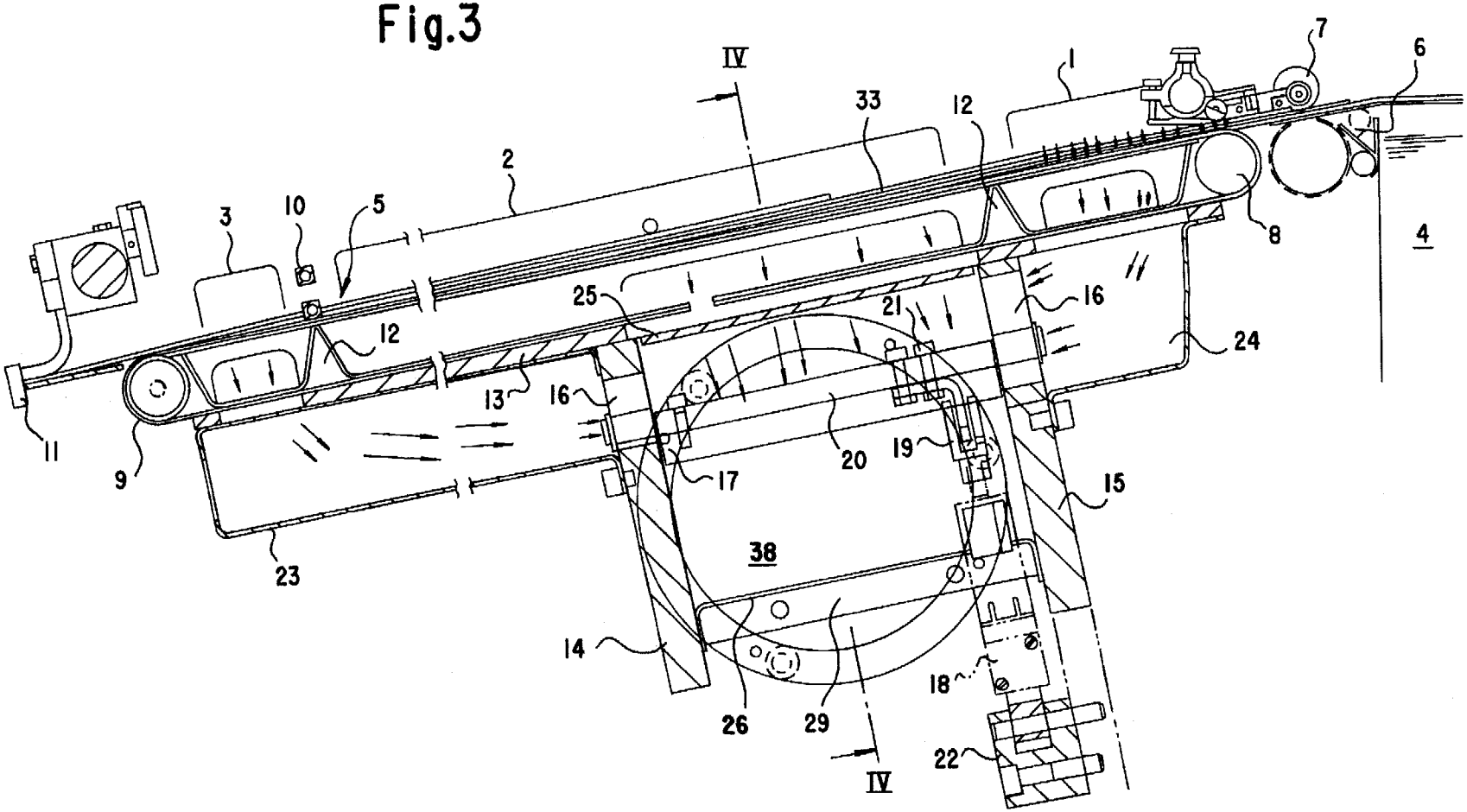
FIG. 3 is a view like that of FIG. 1 of the device according to the invention in another operating phase thereof, wherein the negative pressure is distributed for the feeding of a fully developed shingled or overlapping sheet stream.

In FIG. 3, the negative pressure distribution prevailing in the conveying plane is illustrated with the sheet stream fully developed.

The suction air present in the suction chamber 1 flows into the downstream suction box 24. The suction air then flows through the apertures 16 in the crossbar 15 into the suction pipe union 38, regardless of the operating position of the shutoff element 17. The suction air flow acting upon the middle suction chamber 2 is sucked through the suction pipe union 38, when the shutoff element 17 is positioned downwardly (see FIG. 4). The vacuum present in the suction chamber 3 prevails therein via the forward suction box 23 and the apertures 16 in the crossbar 14 with the suction pipe union 38, regardless of the operating position of the shutoff element 17.

Figure 4:
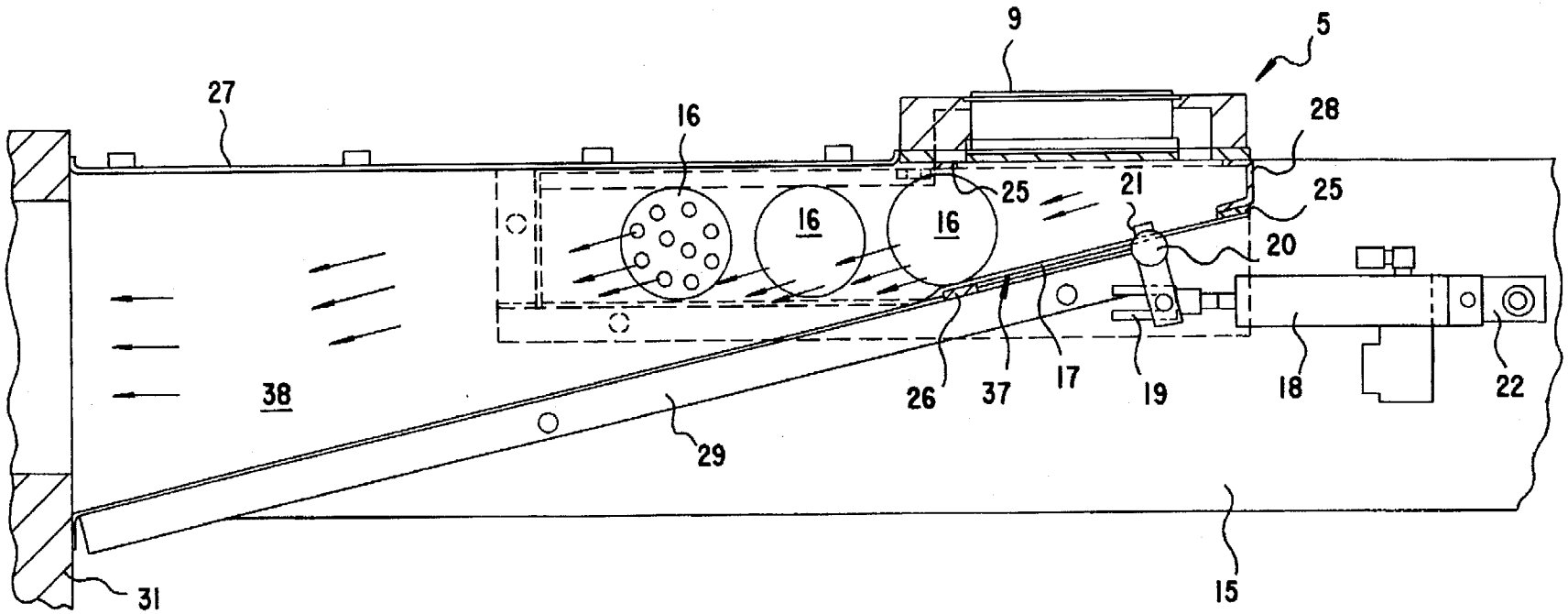
FIG. 4 is a cross-sectional view of FIG. 3 taken along the line IV—IV in the direction of the arrows, and showing the operating position of the swivelable shutoff element.

In FIG. 4, which is a sectional view of FIG. 3 taken along the section line V—V, the operating position 37 of the shutoff element 17 is shown. With the sheet stream fully developed (see FIG. 3), the shutoff element 17 is accordingly swiveled downwardly and, as a result, the vacuum prevailing in the suction pipe union 38 is likewise present in the suction chamber 2 below the conveyor belt 9 which conveys the shingled or overlapping sheet stream. In the operating position 37, the rearward segment of the eccentrically supported shutoff element 17 closes the atmospheric air supply or aeration opening between the swivel shaft 20 and the seal 25 at the end baffle 28.

When the front edge of the first sheet 32 leaves suction chamber 1, the shutoff element 17 swivels into its operating position 37, and the suction chamber 2 is consequently subjected to negative pressure. If the synchronizing rollers 7 are provided above the belt drive roller 8, the downward swiveling of the shutoff element 17 by the actuating device 18 is then effected at the beginning of the phase during which the synchronizing rollers 7 rest on the belt drive roller 8. Thus, while the negative pressure building up in the suction chamber 2 remains reduced, slippage of the first sheet 32 can be effectively prevented. With the shutoff element 17 swiveled into its operating position 37, the system is in a steady state, the system is in a steady state, because continuous feeding of a shingled or overlapping sheet stream can then take place. In the overlapping position, the individual sheets, upon arriving at the front lays 11, are in contact then only with the negative pressure prevailing in the suction chamber 3. In the course of the alignment of the leading edge of the individual sheet contacting the front lays 11 and the side or lateral alignment of this sheet by a lateral alignment straightener device, the sheets fed subsequently take progressively more and more suction away from the underside of the sheet to be aligned, so that its alignment is not impaired by overly strong negative pressure. Moreover, in this way, the thrust of the sheet against the front lays 11, which is also necessary during the peripheral alignment, is maintained. When conveying the final sheet, the presence of which is detectable by any type of sensor, the succeeding sheets, which intercept the suction air of the suction chamber 2 from the final sheet, are no longer present; consequently, the operating conditions vary as well.

Figure 5:
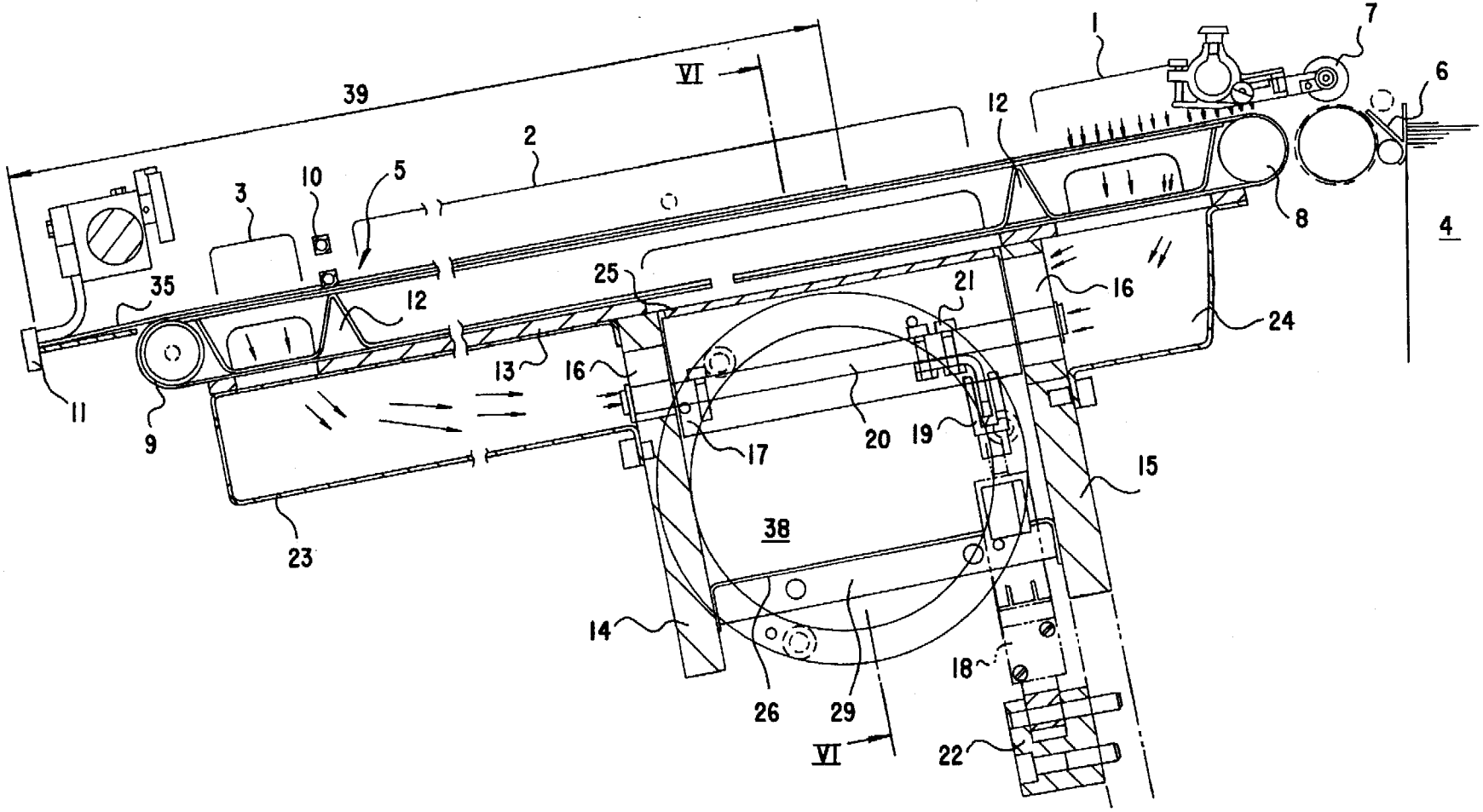
FIG. 5 is another view like that of FIG. 1 of the device according to the invention in yet another operating phase thereof, wherein the negative pressure is distributed for the feeding of the final sheet.

FIG. 5 shows the distribution of negative pressure during the conveyance of the final sheet.

When the final sheet is conveyed, vacuum is imposed only on the suction chambers 1 and 3, respectively at the beginning and the end of the conveying plane 5. The final sheet 35, shown at its maximum length 39 in FIG. 5, extends from its arrival position at the front lays 11 to approximately the end of the suction chamber 2, upstream of the bridge 12. Because the shutoff element 17 is swiveled upwardly, the middle suction chamber 2 communicates with the atmosphere (see FIG. 6), and only the suction chambers 1 and 3 are active. The instant the final sheet 35 approaches the front lays 11, the shutoff element 17 is swiveled into its operating position 36, and the negative pressure operative in the suction chamber 2 is abruptly lessened. Because of the uncovering of the aeration or air supply opening to atmosphere between the seal 25 and the swivel shaft 20 occurs simultaneously, the application of vacuum to the final sheet 35 abruptly abates or weakens. Because the suction chamber 3 remains in communication with the suction pipe union 38, however, the remaining forward thrust necessary for correct lateral alignment is preserved, the unused air aspirated into the suction chamber 1 being insignificant. It would also be conceivable to control the unused air by means of a shutoff device.

Figure 6:
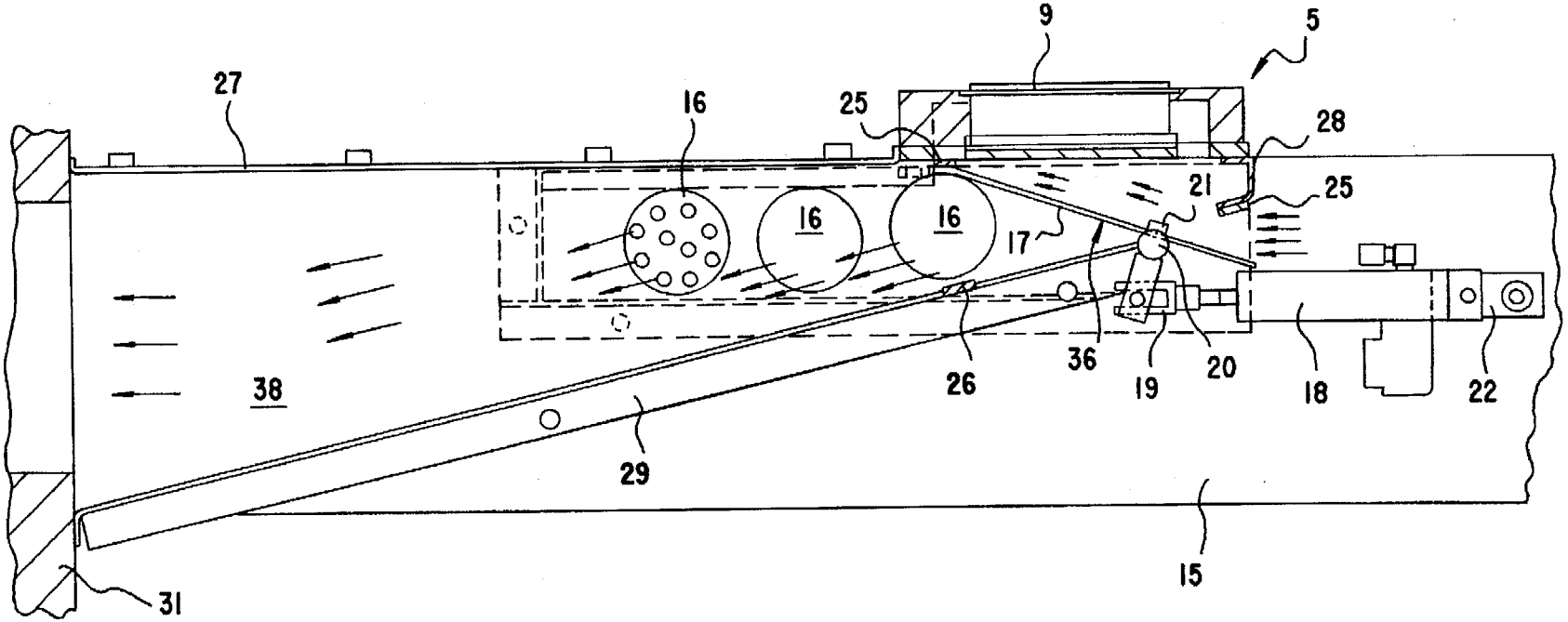
FIG. 6 is a cross-sectional view of FIG. 5 taken along the line VI—VI in the direction of the arrows, and showing the atmospheric aeration of a suction conduit or channel in order to reduce the amount of suction air to which the final sheet is subjected.

As shown in FIG. 6, the operating position 36 for the shutoff element 17 enables the aeration of the suction chamber 2, while the suction chambers 1 and 3, analogously to the conveyance of the first sheet 32, remain in communication with the suction pipe union 38.

Thus, a correct alignment and, accordingly, capability of processing also the final sheet of a shingled or overlapping sheet stream are realizable, without having to contend with spoiled or waste sheets from the outset. The vacuum to which the final sheet 35 of a stream of sheets is exposed is of such dimensions that the conveyance thereof continues to remain assured, a front and lateral alignment is possible due to the residual forward thrust, and a sticking or adhesion of this final sheet due to overly strong vacuum action is avoidable. Another option for varying the imposition of a vacuum on both the first and the final sheets 32 and 35, respectively, resides in a controlling of the power of the suction source at the suction pipe union 38, in a manner that proceeds simultaneously with the swiveling movement of the shutoff element 17.

I claim:

1. Device for adapting negative pressure in a suction belt feed or supply table of a sheet feeder to operating conditions which vary during sheet conveyance, comprising at least one endless, revolvingly driven conveyor belt formed with suction openings, and a side alignment device for laterally aligning a respectively foremost sheet of a shingled or overlapping sheet stream, and at least one suction box disposed below a conveying plane, said suction box, in a sheet feeding direction, being subdivided into a plurality of suction chambers subjectible to negative pressure independently of one another, a common suction union and a swivelable shutoff element for selectively connecting said suction chambers to said suction union, said suction chambers including a middle chamber, said shutoff element selectively connecting said middle chamber with said common suction union or with an air supply opening.

2. Device according to claim 1, wherein said suction union is bounded by a defining plane, and said swivelable shutoff element is disposed in said defining plane.

3. Device according to claim 1, including a swivel shaft to which said swivelable shutoff element is secured eccentrically.

4. Device for adapting negative pressure in a suction belt feed or supply table of a sheet feeder to operating conditions which vary during sheet conveyance, comprising at least one endless, revolvingly driven conveyor belt formed with suction openings, and a side alignment device for laterally aligning a respectively foremost sheet of a shingled or overlapping sheet stream, at least one suction box disposed below a conveying plane, the suction box, in a sheet feeding direction, being subdivided into a plurality of suction chambers subjectible to negative pressure independently of one another, a common suction union, a swivelable shutoff element for selectively connecting said suction chambers to said suction union, and a swivel shaft to which said swivelable shutoff element is secured eccentrically, wherein said swivelable shutoff element is formed with a longer and a shorter segment, respectively, secured to said swivel shaft, said shorter segment being swivelable with said swivel shaft for closing and opening an air supply opening within a boundary.

5. Device for adapting negative pressure in a suction belt feed or supply table of a sheet feeder to operating conditions which vary during sheet conveyance, comprising at least one endless, revolvingly driven conveyor belt formed with suction openings, and a side alignment device for laterally aligning a respectively foremost sheet of a shingled or overlapping sheet stream, at least one suction box disposed below a conveying plane, the suction box, in a sheet feeding direction, being subdivided into a plurality of suction chambers subjectible to negative pressure independently of one another, a common suction union, a swivelable shutoff element for selectively connecting said suction chambers to said suction union, and a swivel shaft to which said swivelable shutoff element is secured eccentrically, said swiveable shutoff element is formed with a longer segment and a shorter segment wherein said longer segment is also secured to said swivel shaft and is swivelable therewith for interrupting communication of at least one of said suction chambers with said suction union.

6. Device for adapting negative pressure in a suction belt feed or supply table of a sheet feeder to operating conditions which vary during sheet conveyance, comprising at least one endless, revolvingly driven conveyor belt formed with suction openings, and a side alignment device for laterally aligning a respectively foremost sheet of a shingled or overlapping sheet stream, at least one suction box disposed below a conveying plane, the suction box, in a sheet feeding direction, being subdivided into a plurality of suction chambers subjectible to negative pressure independently of one another, a common suction union, a swivelable shutoff element for selectively connecting said suction chambers to said suction union, and crossbars to which said suction chambers are secured below the conveying plane.

7. Device according to claim 6, wherein said crossbars, respectively, are perforated with apertures, said apertures being located outside a swiveling range of said swivelable shutoff element.

8. Device according to claim 6, wherein each of said crossbars carries a respective suction box.

9. Device according to claim 7, wherein said suction chambers are in permanent communication with said suction union via said apertures.

10. Device according to claim 6, wherein said crossbars define boundaries of said suction union.

11. Device for adapting negative pressure in a suction belt feed or supply table of a sheet feeder to operating conditions which vary during sheet conveyance, comprising at least one endless, revolvingly driven conveyor belt formed with suction openings, and a side alignment device for laterally aligning a respectively foremost sheet of a shingled or overlapping sheet stream, at least one suction box disposed below a conveying plane, the suction box, in a sheet feeding direction, being subdivided into a plurality of suction chambers subjectible to negative pressure independently of one another, a common suction union and a swivelable shutoff element for selectively connecting said suction chambers to said suction union, wherein said swivelable shutoff element is actuatable by remote control.

* * * * *